US005382264A

United States Patent [19]

Sharma

[11] Patent Number: 5,382,264

[45] Date of Patent: Jan. 17, 1995

[54] PROCESS FOR DYEING SPANDEX FIBERS

[75] Inventor: Jai P. Sharma, Hickory, N.C.

[73] Assignee: UKI Supreme Corporation, Hickory, N.C.

[21] Appl. No.: 957,658

[22] Filed: Oct. 7, 1992

[51] Int. Cl.[6] ..... C09B 45/00

[52] U.S. Cl. ..... 8/685; 8/926; 8/598

[58] Field of Search ..... 8/598, 685, 680, 926

[56] References Cited

U.S. PATENT DOCUMENTS

| | | | |
|---|---|---|---|
| 3,653,798 | 4/1972 | Boardman | 8/480 |
| 3,888,913 | 6/1975 | Baumann et al. | 8/531 |
| 4,166,889 | 9/1979 | Fujii et al. | 8/926 |
| 4,655,785 | 4/1987 | Reinert et al. | 8/442 |

OTHER PUBLICATIONS

"Dyeing and Finishing Fabrics Containing Lycra" Bulletin L-57, E. I. Dupont de Nemours & Co Mar. 1968, pp. 9-24.

*Primary Examiner*—Paul Lieberman
*Assistant Examiner*—Margaret Einsmann
*Attorney, Agent, or Firm*—Rhodes Coats & Bennett

[57] ABSTRACT

A process for dyeing spandex. The process includes the steps of setting the dyebath with an organic acid; adding a pre-metallized acid dye to the dyebath; heating the dyebath until completion of dyeing; and cooling the dyebath. In the preferred embodiment the organic acid is selected from the group including formic and acetic acid. Also, in the preferred embodiment, the dyebath is heated at a rate of between about 0.5 F. and 3 F. per minute up to a temperature of between about 220 F. and 250 F. The resulting dyed spandex passes an AATCC IIA wash test.

4 Claims, No Drawings

PROCESS FOR DYEING SPANDEX FIBERS

BACKGROUND OF THE INVENTION (1) Field of the Invention

The present invention relates generally to the dyeing of textiles and, more particularly, to a process for dyeing spandex-type elastomeric fibers.

(2) Description of the Prior Art

Spandex is a manufactured fiber in which a diisocyanate is reacted with a polyester. The fiber-forming substance is a long chain synthetic polymer comprised of at least 85% of a segmented polyurethane. The most commercially important spandex today is manufactured by DuPont and sold under the trademark LYCRA LUMAFLEX®.

Spandex is lighter in weight, more durable, and more supple than conventional elastic yarn. It can be repeatedly stretched over 650% without breaking and recover instantly to its original length. It does not oxidize and is not damaged by body oils, perspiration, or detergents. Spandex is widely used for foundation garments, bathing suits, hosiery, webbing and fishing lures. However, while spandex can be dyed, the dyed spandex does not possess good fastness and will fail an AATCC Test Method 61-1975 IIA wash test.

U.S. Pat. No. 3,653,798, issued to Boardman, discloses a process for dyeing a blend of spandex and nylon in which a retarder is added to prevent the dye from partitioning strongly in favor of the nylon fibers. However, otherwise the fabric is dyed normally and there would be no expectation of improved IIA wash results.

It is also known to dye nylon fibers with acid or pre-metallized acid dyes which are exhausted in the presence of acetic or formic acid. However, while wetfastness is generally good, the dye does not cover barré and lightfastness varies.

Thus, there remains a need for a process for dyeing spandex-type elastomeric fibers which has a sufficient improvement in fastness as to enable the dyed fiber to pass a IIA wash test.

SUMMARY OF THE INVENTION

The present invention is directed to a process for dyeing spandex which will produce a dyed fiber which will pass an AATCC IIA wash test. The process includes the steps of setting the dyebath with an organic acid; adding a pre-metallized acid dye to the dyebath; heating the dyebath until completion of dyeing; and cooling the dyebath. In the preferred embodiment the organic acid is selected from the group including formic and acetic acid. Also, in the preferred embodiment, the dyebath is heated at a rate of between about 0.5 F. and 3 F. per minute up to a temperature of between about 220 F. and 250 F.

Accordingly, one aspect of the present invention is to provide a process for dyeing spandex. The process includes the steps of: (a) setting the dyebath with an organic acid; (b) adding a pre-metallized acid dye to the dyebath; (c) heating the dyebath until completion of dyeing; and (d) cooling the dyebath.

Another aspect of the present invention is to provide a dyed spandex textile material having improved washfastness.

Still another aspect of the present invention is to provide a dyed spandex textile material having a Class value of greater than 3 when tested according to AATCC Test Method 61-1975 IIA.

These and other aspects of the present invention will become apparent to those skilled in the art after a reading of the following description of the preferred embodiment.

DESCRIPTION OF THE PREFERRED EMBODIMENTS

Spandex yarn can be dyed, however the dyed fabric is unstable and will not pass an AATCC Test Method 61-1975 IIA wash test. The IIA test is an accelerated laundering test designed for evaluating the washfastness of a textile which is exposed to frequent laundering. The test approximates the color loss resulting from five average home launderings in one 45 minute test.

The specimens are laundered under controlled conditions of temperature and abrasive action such that a desired color loss is obtained in a reasonable short time. The abrasive action is accomplished by the use of a low liquor ratio and an appropriate number of steel balls. The test conditions are: water temperature-120 F.; total liquor volume-150 ml; percent detergent of total volume-0.2; number of steel balls 50; and time of test-45 minutes.

After testing, the specimens are evaluated against a reference Gray Scale for Color Change as follows:

Class 5 negligible or no change as shown in Gray Scale Step 5;

Class 4 a change in color equivalent to Gray Scale Step 4;

Class 3 a change in color equivalent to Gray Scale Step 3;

Class 2 a change in color equivalent to Gray Scale Step 2; and

Class 1 a change in color equivalent to Gray Scale Step 1.

Generally, Classes 4 and 5 are considered to be acceptable while Classes 1–3 are considered unacceptable.

In the preferred embodiment, the process for dyeing spandex-type elastomeric fiber according to the present invention includes the following steps: setting the bath with between about 0.5% to 3% weight of the goods (wog) at a liquor ratio of between 1:3 to 1:20 with an organic acid to adjust the pH of the bath to between about 4 to 6; adding a pre-metallized acid dye to the dyebath; heating the dyebath between about 0.5 to 3 F./minute to between about 220 F. and 250 F.; holding the dyebath at temperature for about 60 minutes; and cooling the dyebath.

As shown by the following examples, the critical parameters of the process include the amount of organic acid, the heating rate and the final dyebath temperature. The results are shown below in Examples 1–25. Classes 4 and 5 were considered to be acceptable while Classes 1–3 were considered unacceptable. In the following examples "Y" means acceptable and "N" means unacceptable. The spandex used in the tests was Lycra-brand spandex manufactured by E. I. du Pont de Nemours and Co. of Wilmington, Del.

EXAMPLES 1–10

Dyeings of spandex thread were made to determine the dye yield of the candidate organic acids. The dyes selected were 2% Nylosan Brilliant Flayine E-8G (color index (CI) Acid yellow 184), 0.46% Nylosan Red FRS, and 0.65% Nylosan Yellow N-7GL. These dyes are available from Sandoz, Inc. of E. Hanover, N.J. The dyebath included between about 0.5–1% of Sanda Acid TM as a buffer. Sandacid is the tradename of Sandoz, Inc. of East Handover, N.J. for an organic acid donor for use in dyeing polyamide fibers. The heating rate was 1 F./minute. Dyeing took piece at 220 F. for 60 minutes. Yield was determined after a IIA wash test.

TABLE 1

Organic Acid Trial Results

| Example | Composition | Suitable | pH | Yield |
|---|---|---|---|---|
| 1 | formic acid (90%) 0.5% | N | 6–6.5 | light |
| 2 | formic acid (90%) 1.0% | Y | 5–6 | good |
| 3 | formic acid (90%) 2.0% | Y | 4–5.5 | very good |
| 4 | formic acid (90%) 3.0% | N | 3 | streaks |
| 5 | formic acid (90%) 4.0% | N | 2 | streaks |
| 6 | formic acid (90%) 5.0% | N | — | streaks |
| 7 | formic acid (90%) 6.0% | N | — | streaks |
| 8 | formic acid (90%) 7.0% | N | — | streaks |
| 9 | acetic acid (90%) 1.5% | Y | 5 | good |
| 10 | acetic acid (90%) 2.0% | Y | 4 | good |

The above examples indicate that organic acids selected from the group including formic or acetic acid will produce acceptable dyeing when added at between about 1–2% to set the dyebath pH at between about 4–6. The preferred embodiment is 1–2% formic acid.

EXAMPLES 11–17

Dyeings of spandex thread were made to determine the dye yield of the candidate dyes. The dyebath was set with 2% formic acid. The dyebath included between about 0.5–1% of Sanda Acid TM as a buffer. The heating rate was 1 F./minute. Dyeing took place at 220 F. for 60 minutes. Yield was determined after a IIA wash test.

TABLE 2

Dye Trial Results

| Example | Dye Type | Suitable | Yield |
|---|---|---|---|
| 11 | disperse foron brill. 2% yellow (CI yellow 49) | N | poor |
| 12 | disperse foron brill. 1% violet S3RL (CI violet 63) | N | poor |
| 13 | acid telon fast blk.LD (CI acid black 194) | Y | good |
| 14 | acid telon violet 2% ABBN 200% (CI acid violet) pre-metallized/bisulfonic | Y | good |
| 15 | acid langsyn black 3% S-GLPD (CI unknown) Acid Dye. | Y | good |
| 16 | acid nylosan violet 2% F-BL (CI violet 48) pre-metallized/monosulfonic | Y | good |
| 17 | acid nylosan brill. 2% flayine E-80 (CI yellow 184) Acid Dye. and acid isolan dk. brwn. 1–4% I-TLN (CI unknown) pre-metallized | Y | good |

The above examples indicate that pre-metallized acid dyes selected from the group including monosulfonic and bisulfonic dyes will produce acceptable dyeing when added at between about 1 and 4%. Also, in the preferred embodiment, both mono and bisulfonic dyes are used to dye dark shades, such as brown. The following dyeings were made using representative samples of the above pre-metallized acid dyes.

EXAMPLES 18–22

Dyeings of spandex thread were made to determine the dye yield for various heating rates. The dyebath was set with 2% formic acid. The dyebath included between about 0.5–1% of Sanda Acid TM as a buffer. Dyeing took place at 220 F. for 60 minutes. Yield was determined after a IIA wash test.

TABLE 3

Heating Rate Trial Results

| Example | Heating Rate (F/Minute) | Suitable | Yield |
|---|---|---|---|
| 18 | 0.5 | Y | good |
| 19 | 1.0 | Y | good |
| 20 | 2.0 | Y | good |
| 21 | 3.0 | Y | good |
| 22 | 4.0 | N | streaks |

The above examples indicate that a heating rate of between about 0.5 F./minute and 3 F./minute is necessary to produce acceptable dye yield.

EXAMPLES 23–25

Dyeings of spandex thread were made to determine the dye yield for various dyeing temperatures. The dyebath was set with 2% formic acid. The dyebath included between about 0.5–1% of Sanda Acid TM as a buffer. The heating rate was 2 F./minute and the dyeing time was 60 minutes. Yield was determined after a IIA wash test.

TABLE 4

Temperature Trial Results

| Example | Temperature (F.) | Suitable | Yield |
|---|---|---|---|
| 23 | 212 | N | poor |
| 24 | 220 | Y | good |
| 25 | 250 | Y | good |

The above examples indicate that a dyebath temperature of between about 212 F. and 250 F. is necessary to produce acceptable dye yield.

Certain modifications and improvements will occur to those skilled in the art upon reading of the foregoing description. It should be understood that all such modifications and improvements have been deleted herein for the sake of conciseness and readability but are properly within the scope of the following claims.

We claim:

1. A process for dyeing spandex, said process comprising the steps of:

(a) setting the dyebath to a pH of between about 4 to 6 with an organic acid selected from the group consisting of formic and acetic acid;

(b) adding a pre-metallized acid dye to the dyebath;

(c) submitting the spandex to the dyebath;

(d) heating the dyebath at a rate of between about 0.5° F. and 3° F. per minute to between about 220° F. and 250° F., holding the bath at said temperature range for about 1 hour until completion of dyeing; and (e) cooling the dyebath.

2. The process according to claim 1, wherein said organic acid is between about 0.5 to 3 wt %.

3. The process according to claim 1, wherein said pre-metallized acid dye is selected from the group consisting of bisulfonic and monosulfonic dyes.

4. A dyed spandex textile material produced having improved washfastness prepared according to the process of claim 1.

* * * * *